US006609760B1

(12) United States Patent
Matern et al.

(10) Patent No.: US 6,609,760 B1
(45) Date of Patent: Aug. 26, 2003

(54) CHAIR CONTROL ACTUATOR WITH DEPICTION

(75) Inventors: Gerard J. Matern, Waterloo (CA); Arthur A. Patton, Waterloo (CA)

(73) Assignee: Leggett & Platt Ltd., Waterloo (CA)

( * ) Notice: Subject to any disclaimer, the term of this patent is extended or adjusted under 35 U.S.C. 154(b) by 0 days.

(21) Appl. No.: 10/097,705

(22) Filed: Mar. 14, 2002

(51) Int. Cl.[7] ..... A47B 97/00

(52) U.S. Cl. ..... 297/463.1; 297/183.1; 297/285; 297/354.1; 297/344.16; 297/463.2; 40/661.12; 40/320

(58) Field of Search ..... 297/463.1, 183.1, 297/285, 354.1, 344.16, 344.19, 463.2; 40/661.12, 320, 331

(56) References Cited

U.S. PATENT DOCUMENTS 2,473,648 A * 6/1949 Jakeway
2,586,978 A * 2/1952 Murray
3,653,136 A * 4/1972 Ruppert
6,174,031 B1 * 1/2001 Lindgren et al.
6,227,615 B1 5/2001 Newhouse et al. .... 297/188.11

* cited by examiner

*Primary Examiner*—Laurie K. Cranmer
(74) *Attorney, Agent, or Firm*—Shook, Hardy & Bacon L.L.P.

(57) ABSTRACT

A chair control actuator, such as a chair control paddle, is provided with a surface relief. The surface relief depicts a chair in two different positions illustrative of different chair positions which may result from use of said actuator. The surface relief has solid relief areas depicting a first of the two positions and outline relief areas depicting a second of the two positions.

15 Claims, 6 Drawing Sheets

CHAIR CONTROL ACTUATOR WITH DEPICTION

BACKGROUND OF THE INVENTION

This invention relates to a chair control actuator.

In an effort to accommodate a wide range of user's preferences and physical characteristics, adjustable chairs have been manufactured with an increasing number of possible adjustments. Each new adjustment feature typically requires a new actuator. For modem office chairs, the result can be a chair control festooned with actuators. In consequence, a new or infrequent user of a chair may engage in considerable experimentation before succeeding in effecting desired chair adjustments.

U.S. Pat. No. 6,227,615 to Newhouse addresses this problem by providing a card with a pictorial guide for operating the adjustable chair. A device mounts the card to the bottom of the seat of the chair and allows the card to move between an extended position wherein the pictorial guide is visible to an occupant of the chair and a retracted position wherein the pictorial guide is not visible to the occupant of the chair. Also, the mounting device holds the card so that the orientation of the pictorial guide corresponds to the orientation of the controls for adjusting the chair when the card is in the extended position.

The approach of Newhouse, while helpful, requires that a user know of the existence of the card and be able to properly correlate the depiction of the controls with the actual controls. Additionally, the approach is dependent upon the pictorial guide not becoming dislodged from the chair.

Therefore, there remains a need for chair controls that are easily understood by a user even given wear and tear on the chair.

SUMMARY OF INVENTION

A chair control actuator, such as a chair control paddle, is provided with a surface relief. The surface relief depicts a chair in two different positions illustrative of different chair positions which may result from use of the actuator. The surface relief has solid relief areas depicting a first of the two positions and outline relief areas depicting a second of the two positions.

The invention also contemplates a chair control mechanism having such chair control actuators.

Other features and advantages will become apparent upon review of the following description in conjunction with the drawings.

BRIEF DESCRIPTION OF THE DRAWINGS

In the figures which disclose example embodiments of the invention.

DETAILED DESCRIPTION

Figure 1:
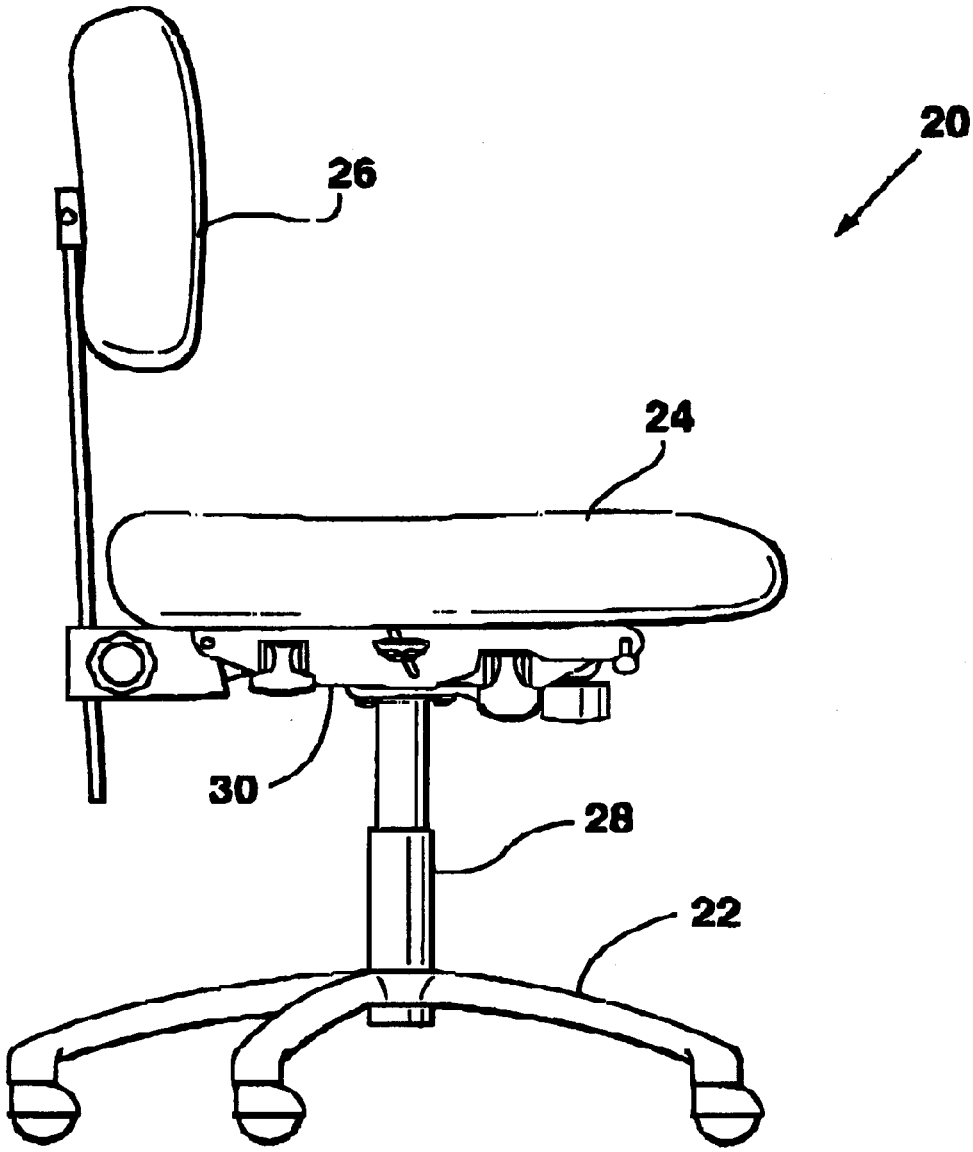
FIG. 1 is a side view of a chair to which the teachings of this invention may be applied.
Figure 2:
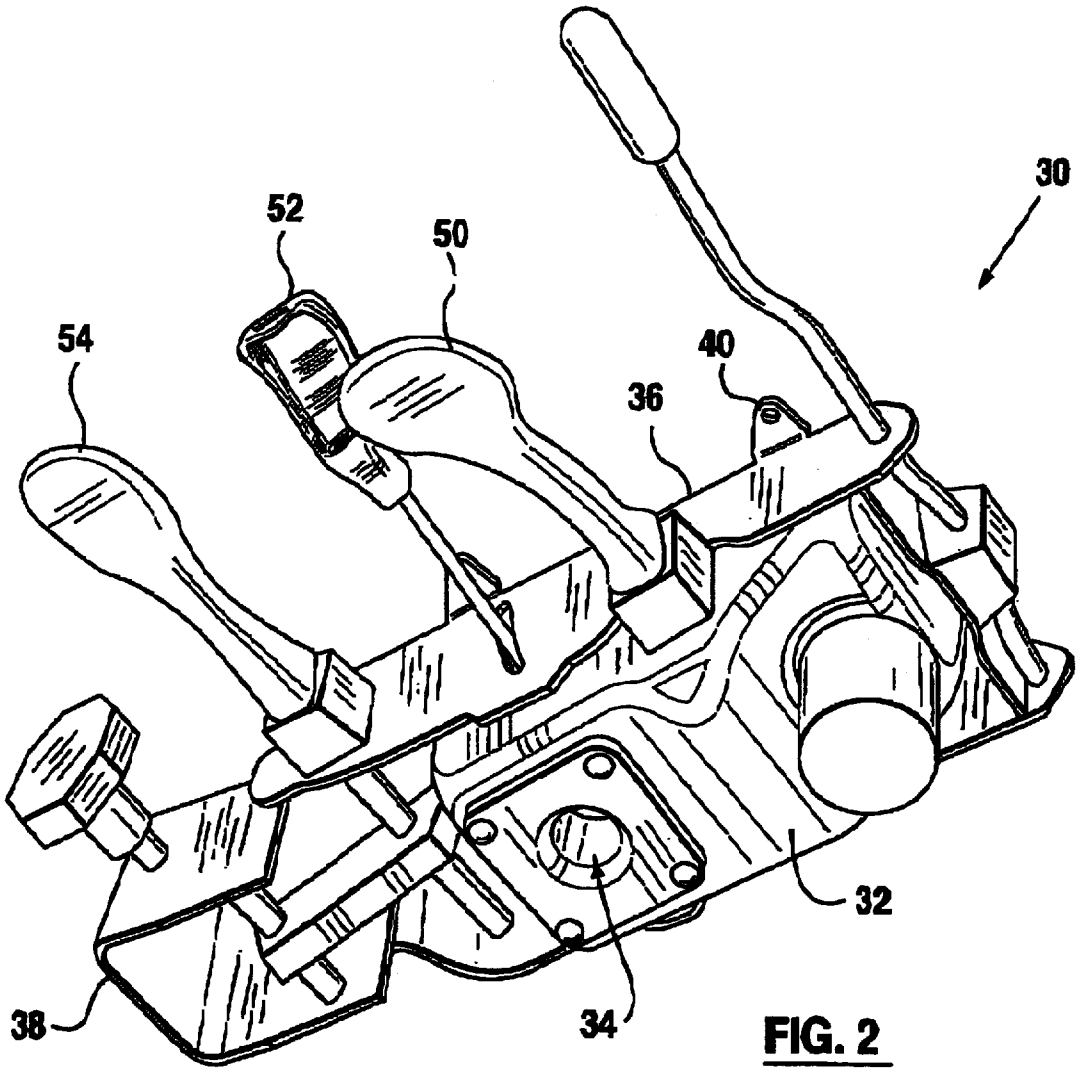
FIG. 2 is a perspective view of the chair control mechanism of the chair of FIG. 1.
Figure 3:
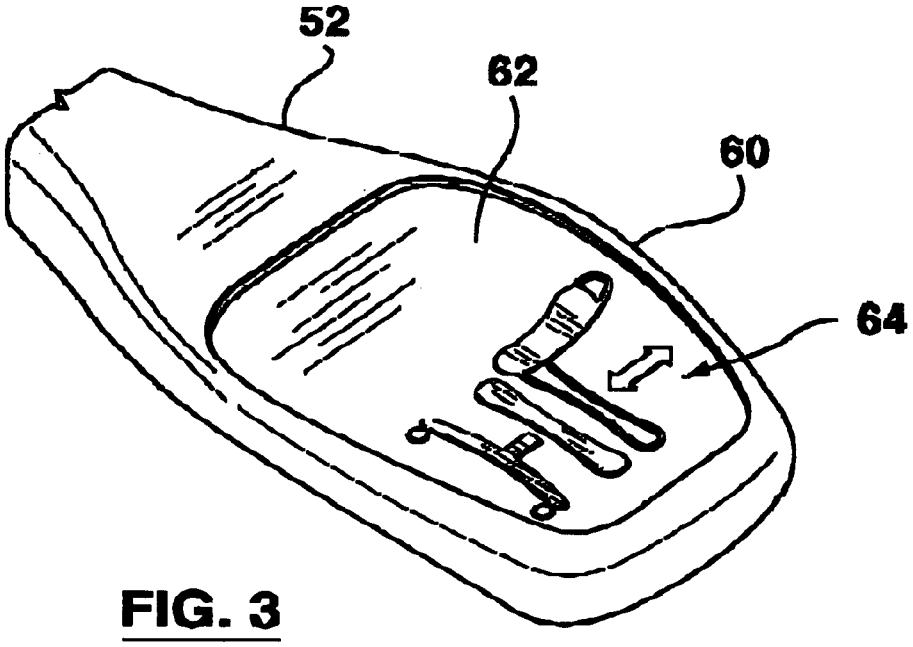
FIG. 3 is a top perspective view of the end of an actuator of the chair control mechanism of FIG 2.
Figure 5:
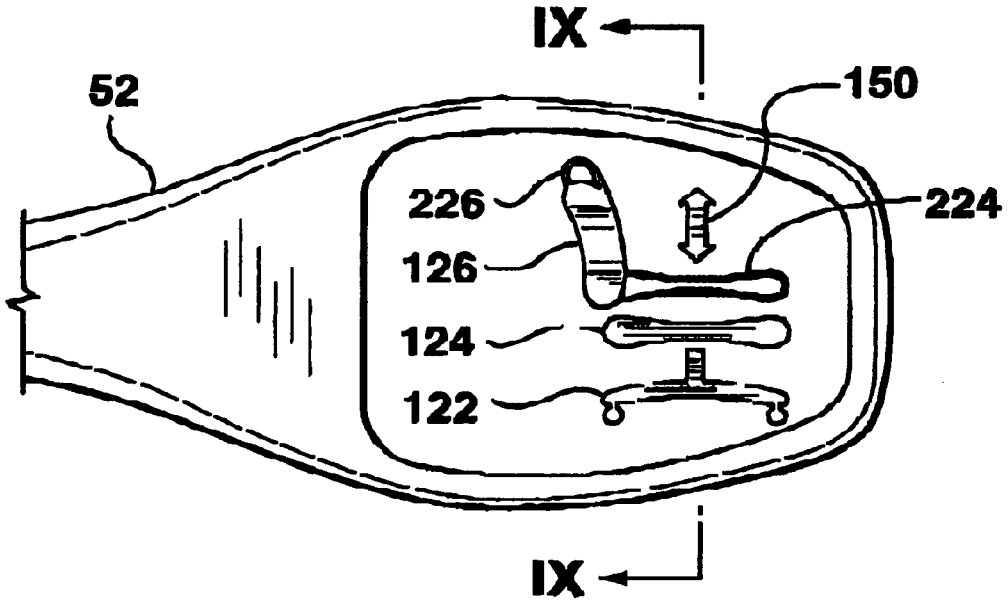
FIG. 5 is a top view of the actuator end of FIG. 3.
Figure 7:
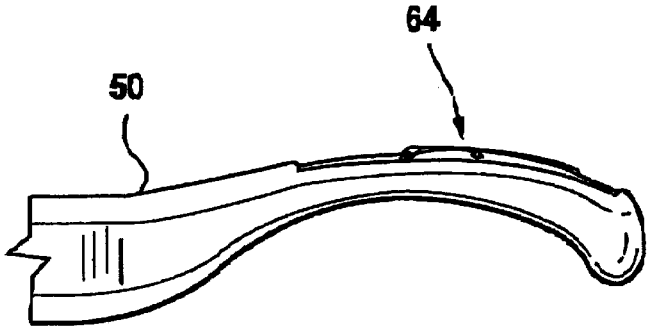
FIG. 7 is a side view of the actuator end of FIG. 3.
Figure 8:
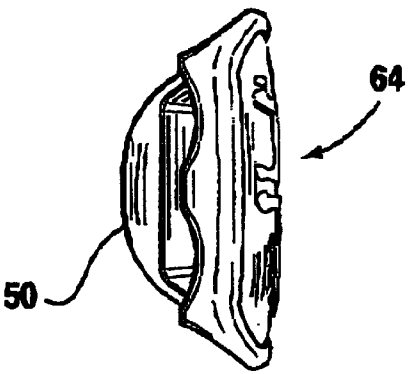
FIG. 8 is an end view of the actuator end of FIG. 3.
Figure 4:
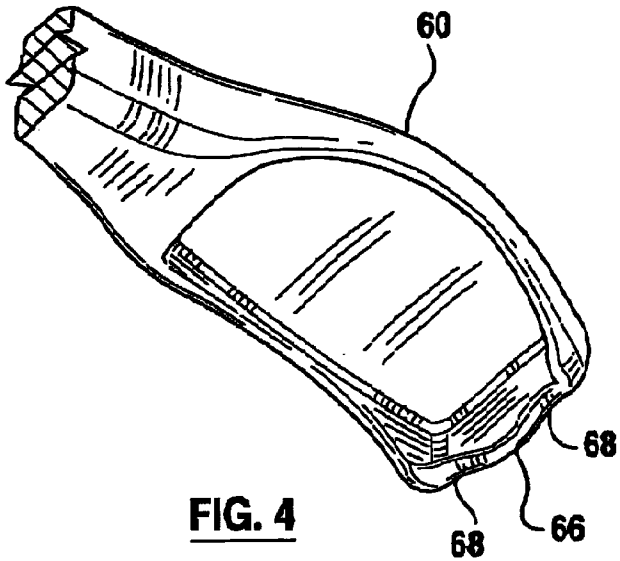
FIG. 4 is a bottom perspective view of the actuator end of FIG. 3.
Figure 6:
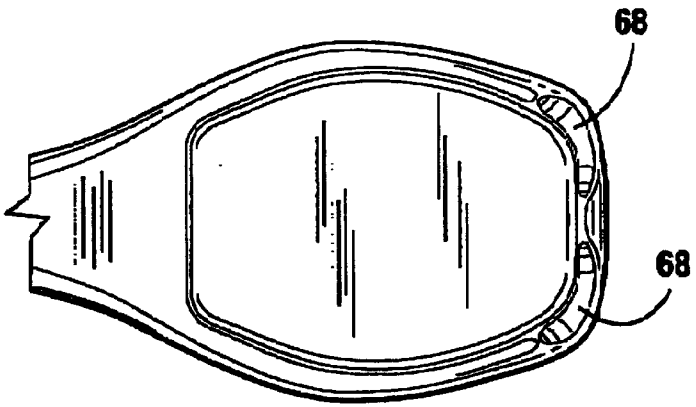
FIG. 6 is a bottom view of the actuator end of FIG. 3.

Turning to FIG. 1, a chair 20 has a base 22, seat 24, and backrest 26 each joined to chair control mechanism 30. More particularly, turning to FIG. 2 along with FIG. 1, the chair control mechanism 30 has a main frame 32 with a cylindrical opening 34 which receives the end of air cylinder 28 of the base 22 of chair 20. A seat plate 36 and a back bracket 38 of the chair control are pivotably mounted to the main frame 32. The seat plate 36 has mounting flanges 40 to allow the mounting of seat 24 to the seat plate. The back bracket 38 receives the arm 29 of backrest 26 in order to mount the backrest of the chair.

Chair control mechanism 30 has a number of actuators including actuators 50, 52, and 54. Actuator 50 has two positions, one which locks seat plate 36 in a fixed orientation with respect to main frame 32 and the other which frees the seat plate to pivot with respect to the main frame. Thus, with actuator in its unlocking position, the seat of chair 20 is free to tilt forwardly or rearwardly with respect to the base 22 of the chair. Actuator 52 has a raised, inactive, position, and a lowered position whereat the actuator depresses the valve control finger (not shown) of the air control cylinder 28 thereby allowing a height adjustment of a chair having the chair control mechanism 30. Actuator 54 has two positions, one which locks the backrest bracket 38 in fixed orientation with respect to main frame 32 and the other which frees the back bracket to pivot with respect to the main frame. Thus, with actuator 54 in its unlocking position, the backrest 26 of chair 20 is free to tilt rearwardly with respect to the base of the chair.

FIGS. 3 to 9 show the paddle-shaped end 60 of actuator 52. With reference to FIGS. 3, 5, 7, and 9, it will be apparent that the top surface of actuator end 60 has a recessed area 62 with a surface relief 64, being a pictograph of chair 20 (FIG. 1), in two different positions. The two positions are illustrative of different chair positions which may result from use of actuator 52. The surface relief 62 has solid relief areas 122, 124, and 126 pictorially representing, respectively, the base, seat, and backrest of chair 20. The surface relief also has outline relief areas 224, 226 depicting, respectively, the seat and a portion of the backrest of the chair in a second position. Each outline area is formed by a wall that is in relief. Thus, outline relief area 224 is a wall outlining the shape of the seat and outline relief area 226 is a wall outlining a portion of the backrest. As will be apparent, the solid relief areas include portions of the chair 20 which are not controlled by actuator 52.

By utilising solid relief areas to depict the chair in one position and outline areas to depict it in another, the two different positions of the chair are contrasted and, therefore, easily understood. Furthermore, given that this contrast is in relief, a user may be able to sufficiently discern the pictograph by touch. Thus, the pictograph can be, in effect, a type of Braille allowing a user to find a proper actuator without having to look down at the actuator.

The actuator also has a solid surface relief 150 depicting a double-headed arrow oriented to indicate a direction of change between the first position of the chair seat (relief 124) and the second position of the chair seat (relief 224).

Figure 9:
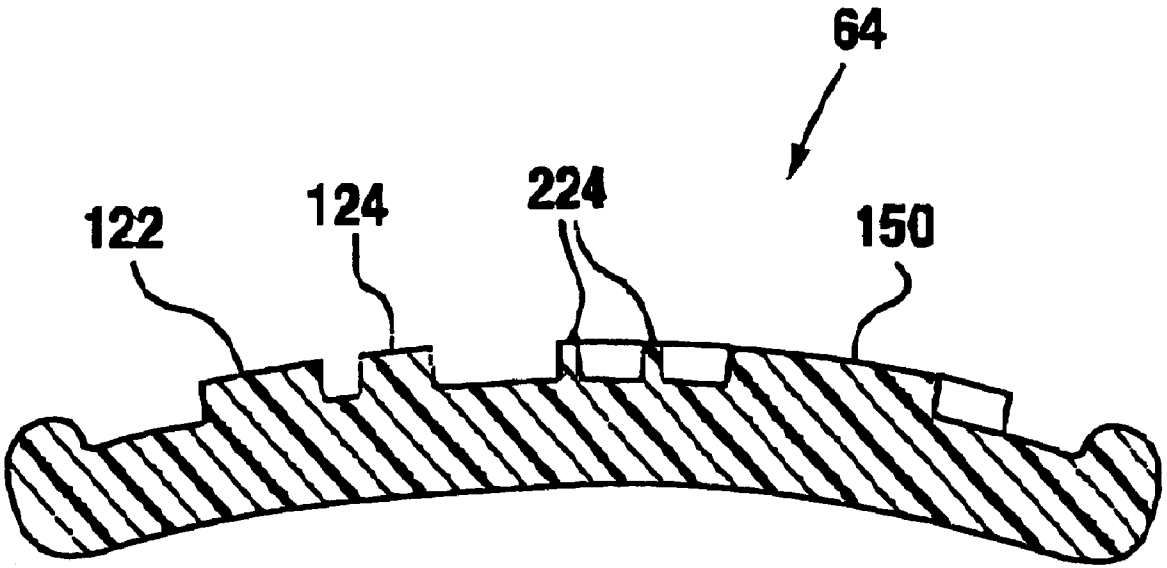
FIG. 9 is a cross-sectional view along the lines IX—IX of FIG. 5, and FIGS. 10 to 12 are top views of other actuator ends.

As will be apparent from FIG. 9, the surface relief 64 is integrally formed with the end 60 of the actuator. In consequence, the relief will normally endure for the useful life of the actuator. One suitable material for the end of the actuator is glass-filled nylon.

With reference to FIGS. 4 and 6 to 8, it will be apparent that the bottom surface of the actuator end 60 has a lip 66 with a pair of finger receiving notches 68. These assist a user in comfortably grasping the actuator.

Figure 10:
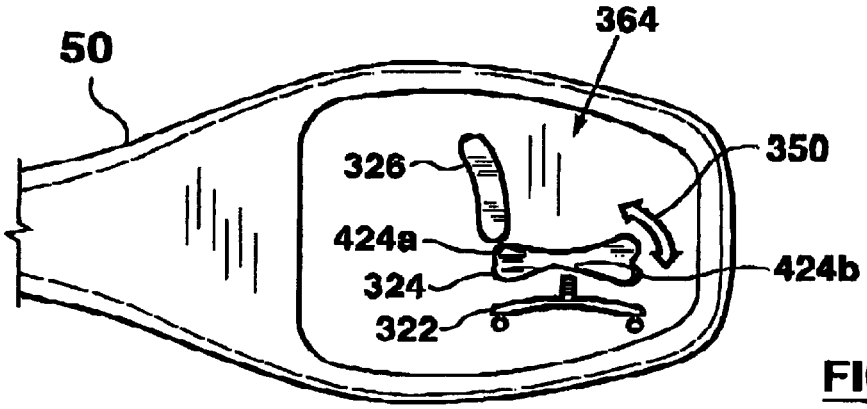

FIG. 10 illustrates the surface relief 364 of actuator 50. Solid relief portions 322, 324, and 326 pictographically depict the base, seat, and back of chair 20 (FIG. 1). Outline relief portions 424*a*, 424*b* depict the seat in a second position. Double-headed arrow 350 illustrates the direction of motion of the seat of chair 20 between the positions illustrated by relief portion 324 and that represented by relief portions 424*a*, 424*b*. Thus, the surface relief 364 illustrates possible adjustments to the chair with the actuator 50.

Figure 11:
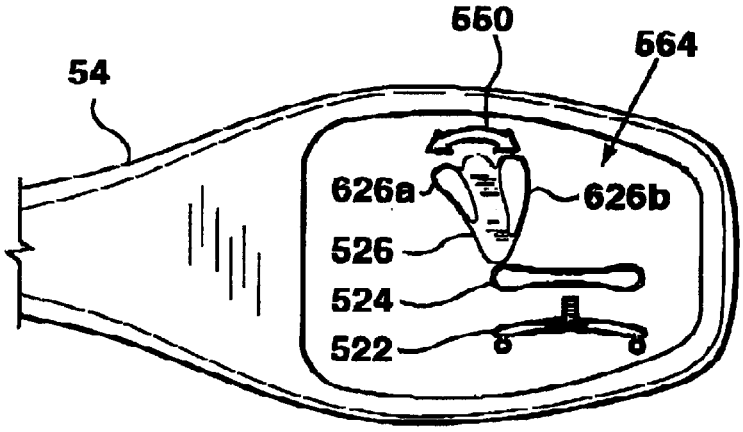

FIG. 11 illustrates the surface relief 564 of actuator 54. Solid relief portions 522, 524, and 526 pictographically depict the base, seat, and back of chair 20 (FIG. 1). Outline relief portions 626*a*, 626*b* depict the back in a second position. Double-headed arrow 550 illustrates the direction of motion of the back of chair 20 between the positions illustrated by relief portion 526 and that represented by relief portions 626*a*, 626*b*. Thus, the surface relief 564 illustrates possible adjustments to the chair with the actuator 54.

Figure 12:
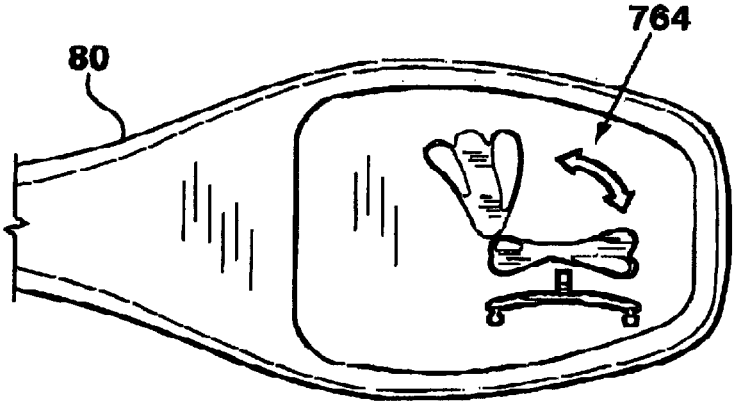

Other chair controls could be equally represented in the manner described. For example, a chair control which allowed simultaneous tilting of the seat and back of chair 20 could be as depicted by the relief 764 of actuator 80 of FIG. 12.

Other modifications will be apparent to those skilled in the art and, therefore, the invention is defined in the claims.

What is claimed is:

1. A chair control actuator comprising:

a surface relief depicting a chair in two different positions illustrative of different chair positions which may result from use of said actuator, said surface relief having solid relief areas depicting a first of said two positions and outline relief areas depicting a second of said two positions.

2. The actuator of claim 1 wherein said solid relief areas include portions of said depicted chair not controlled by said actuator.

3. The actuator of claim 1 further comprising a surface relief depicting a double-headed arrow oriented to indicate a direction of change between said first of two positions and said second of two positions.

4. The actuator of claim 1 further comprising a recessed area, said surface relief extending within said recessed area.

5. The actuator of claim 1 wherein said actuator has a paddle-shaped end bearing said surface relief.

6. The actuator of claim 5 wherein a top surface of said paddle-shaped end bears said surface relief.

7. The actuator of claim 6 wherein a bottom surface of said paddle has a lip with a pair of finger receiving notches.

8. A chair control paddle actuator comprising:

a surface relief depicting a chair in two different positions illustrative of different chair positions which may result from use of said actuator, said surface relief having solid relief areas depicting a first of said two positions and outline relief areas depicting a second of said two positions.

9. A chair control mechanism, comprising:

a plurality of chair control actuators, each actuator having a surface relief depicting a chair in two different positions illustrative of different chair positions which may result from use of said each actuator, said surface relief having solid relief areas depicting a first of said two positions and outline relief areas depicting a second of said two positions.

10. The control mechanism of claim 9 wherein said solid relief areas include portions of said depicted chair not controlled by said actuator.

11. The control mechanism of claim 10 wherein each said actuator further comprises a surface relief depicting a double-headed arrow oriented to indicate a direction of change between said first of two positions and said second of two positions.

12. The control mechanism of claim 11 wherein each said actuator further comprises a recessed area, said surface relief extending within said recessed area.

13. The control mechanism of claim 12 wherein said each actuator has a paddle-shaped end bearing said surface relief.

14. The control mechanism of claim 13 wherein a top surface of said paddle-shaped end bears said surface relief.

15. The control mechanism of claim 14 wherein a bottom surface of said paddle has a lip with a pair of finger receiving notches.

* * * * *